US008033530B2

(12) United States Patent
Timothy

(10) Patent No.: US 8,033,530 B2
(45) Date of Patent: Oct. 11, 2011

(54) STAIR RAIL ASSEMBLY

(75) Inventor: E. Erik Timothy, Apollo Beach, FL (US)

(73) Assignee: Nationwide Industries, Inc., Tampa, FL (US)

( * ) Notice: Subject to any disclaimer, the term of this patent is extended or adjusted under 35 U.S.C. 154(b) by 285 days.

(21) Appl. No.: 11/969,548

(22) Filed: Jan. 4, 2008

(65) Prior Publication Data

US 2009/0173926 A1 Jul. 9, 2009

(51) Int. Cl.
*E04H 17/16* (2006.01)
*E04H 17/14* (2006.01)

(52) U.S. Cl. ..... 256/22; 256/69; 256/70

(58) Field of Classification Search ..... 403/67, 403/193, 195, 239, 277, 290, 297, 313–315, 403/370, 371, 374.1–374.4; 256/67, 22, 69, 70

See application file for complete search history.

(56) References Cited

U.S. PATENT DOCUMENTS 2,972,495 A * 2/1961 Yalen ..... 403/297
3,461,772 A * 8/1969 Barry ..... 411/80.1
3,485,519 A * 12/1969 Chiu ..... 403/297
3,955,800 A * 5/1976 Russo ..... 256/59

* cited by examiner

*Primary Examiner* — Victor MacArthur
(74) *Attorney, Agent, or Firm* — George R. McGuire; David B. Woycechowsky; Bond Schoeneck & King

(57) ABSTRACT

A stair rail assembly for easy and rapid installation. The assembly includes a baluster, baluster shoe, and a rail. The baluster shoe comprises an anchor and a base having an opening extending through the anchor and base. The base fits flush against a rail and the anchor fits within a baluster to connect the baluster to the rail. The anchor contains flexible walls which expand upon insertion of a screw to frictionally engage the baluster.

9 Claims, 4 Drawing Sheets

STAIR RAIL ASSEMBLY

REFERENCE TO RELATED APPLICATIONS

This application relates to U.S. Design Pat. Nos. D544,107 and D544,106, which are hereby incorporated by reference.

BACKGROUND

The present invention relates generally to baluster assemblies, and more particularly to devices for attaching balusters to rails.

Rail assemblies typically include a hand rail and a shoe rail, which are disposed in generally parallel relationship. A plurality of generally vertical balusters extend intermediate the hand rail and the shoe rail. Many of the assemblies in the prior art include intricate constructions involving numerous components and bolts for connecting the balusters to the rails. U.S. Pat. No. 6,141,928 is directed to a post mount requiring a support block, an adjustment plate requiring a plurality of adjustment bolts, a bearing plate and clamping plate, a bolt, a nut, and a plurality of compression pins. The amount of parts and amount of detail required to assemble the post mount result in a laborious and time-consuming process.

Additionally, some rail assemblies may not be able to support the weight imposed on them. U.S. Pat. No. 4,403,767 is directed to a stair rail assembly having a connector requiring both a plug and socket member to connect a baluster to a rail. The strength of the connection between the baluster and the rail is determined by the strength of the connection between the plug and socket, which may be insufficient if too much force is applied to the connection.

It is a primary object of the invention to provide a baluster and rail system that is quick and easy to assemble. It is another object of the invention to provide a system that withstands a great amount of force. It is a further object of the invention to provide a system with few parts to assemble. It is a yet another object of the invention to provide a system that allows for easy shipment of parts. It is yet a further object of the invention to provide a system that has hidden fasteners.

SUMMARY OF THE INVENTION

These and other objects and advantages are accomplished by a rail assembly comprising a baluster, baluster shoe or connector, and a rail. The baluster is secured to the rail by the baluster shoe. The components fit easily together for quick installation.

Specifically, in one embodiment, the baluster shoe comprises an anchor section and a base section having an opening extending through the anchor and base sections. The bottom of the base section fits flush against the rail and the anchor section mounts within the baluster to connect the baluster to the rail. When viewed laterally, the cross-sectional area of the base section is larger than the cross-sectional area of the anchor section. The baluster has a channel with a shape that corresponds to the shape of the anchor and which cross-sectional area corresponds to the cross-sectional area of the anchor, such that the anchor section fits tightly and securely inside the channel of the baluster when the baluster is mounted onto the baluster shoe. The bottom edge of the baluster sits flush against the top of the base section, which cross-sectional area may be similar to or greater than the cross-sectional area of the channel of the baluster, such that the base section of the baluster shoe appears as a continuation of the baluster or as the base of the baluster when all parts are assembled.

The anchor section contains flexible walls which form an opening. The opening may be large enough to insert the tip of a screw to be inserted therein, but may be slightly smaller than the diameter of the shaft of the screw, or similar to the size of the diameter of the screw, to tightly engage the screw. It is preferable that the anchor section is formed by two vertically extending walls disposed parallel to one another, forming an opening or slit for positioning a screw. Upon insertion of a screw, the exertion of the screw into the opening spreads open the walls in order to fit the screw therein.

For installation, the system is assembled by inserting the baluster shoe into the baluster and positioning the baluster shoe onto the rail. A screw is inserted through the hole in the rail and through the opening in the base and anchor sections of the baluster shoe. As the screw is inserted in the anchor section, the flexible walls of the anchor section spread out as a result of the placement of the screw therein. The screw connects the rail to the anchor. The expansion of the anchor walls in the channel of the baluster creates a retention force to provide a tight, secure fit for the anchor within the baluster. As a result, the force exerted by the screw onto the walls of the anchor engages and retains the baluster such that a tight and secure connection is achieved to retain the baluster in place upon the baluster shoe.

BRIEF DESCRIPTION OF THE DRAWINGS

The present invention will be more fully understood and appreciated by reading the following Detailed Description in conjunction with the accompanying drawings, in which.

DETAILED DESCRIPTION

Figure 1:
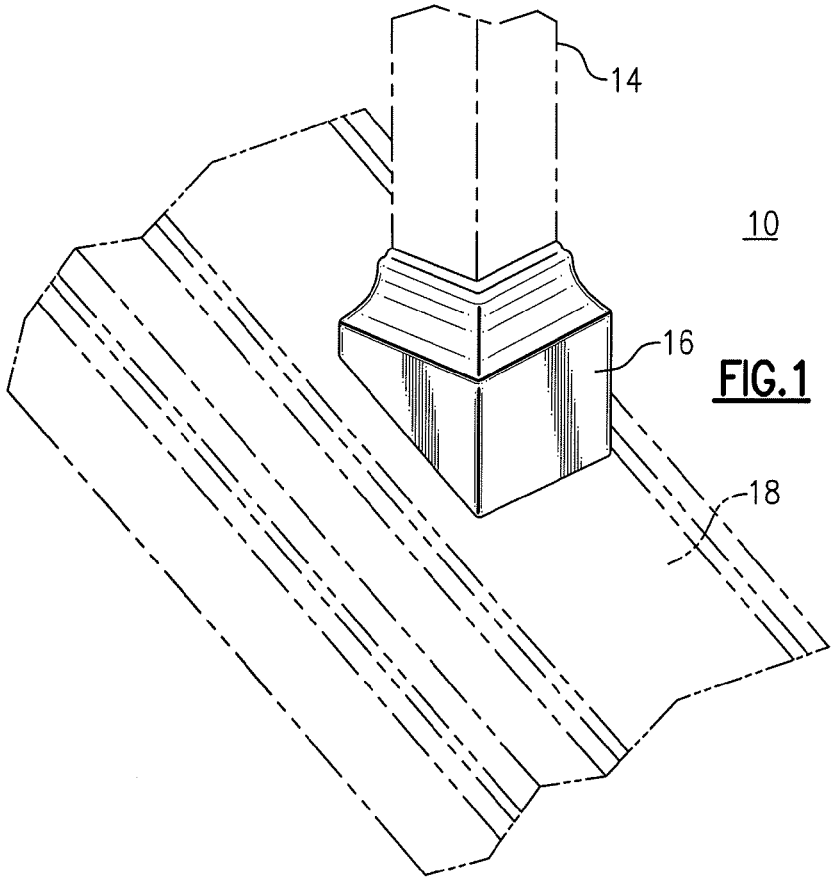
FIG. 1 is a perspective view of the baluster assembly of the present invention.
Figure 2:
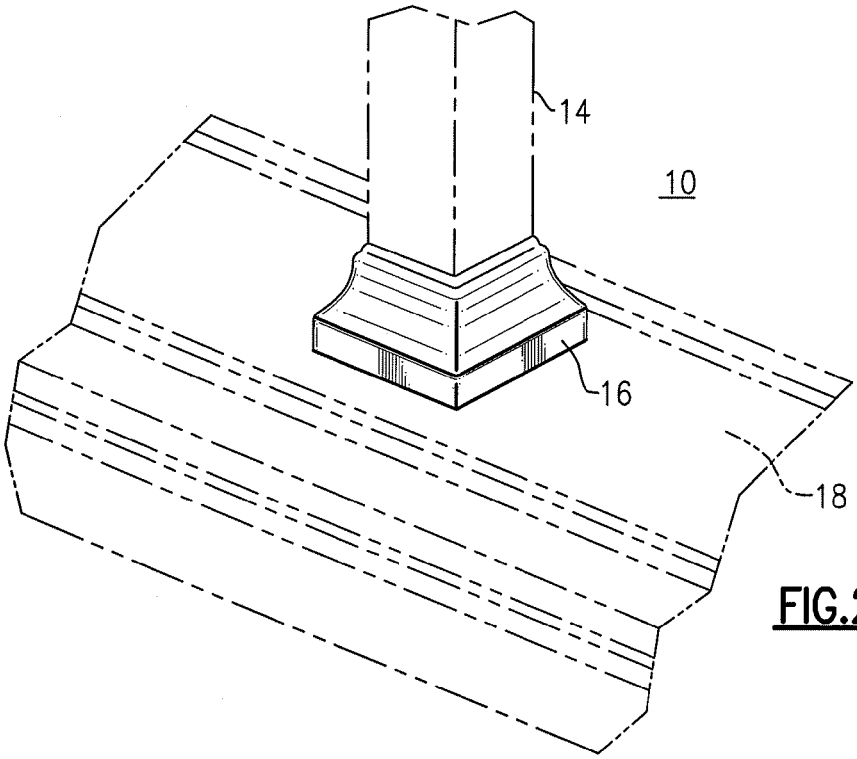
FIG. 2 is a perspective view of an alternate embodiment of the baluster assembly of the present invention.
Figure 3:
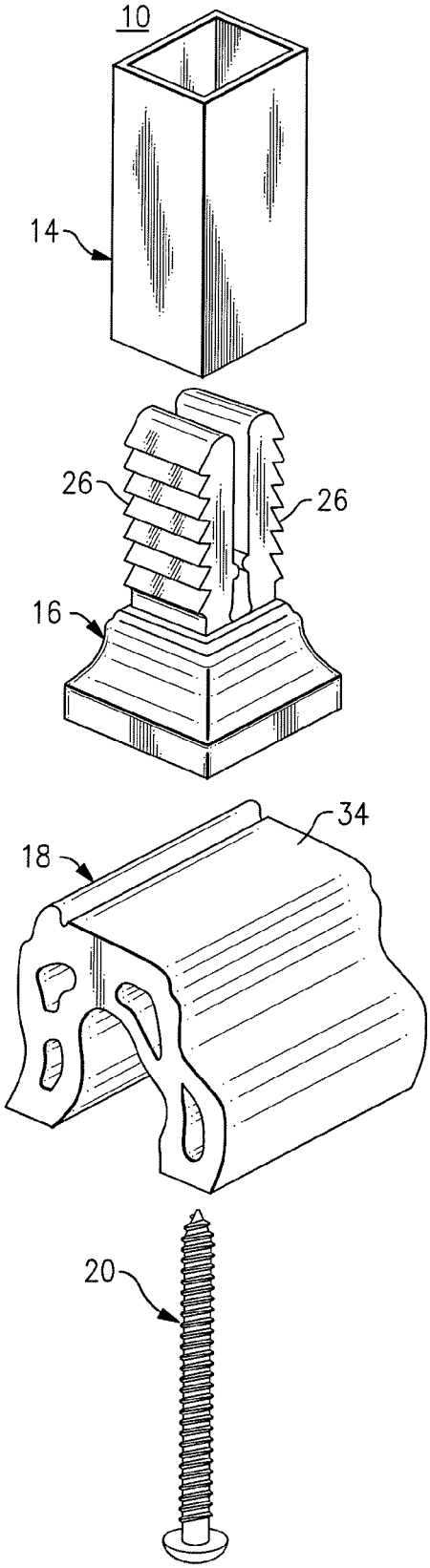
FIG. 3 is an exploded view of the baluster assembly of the present invention.
Figure 4:
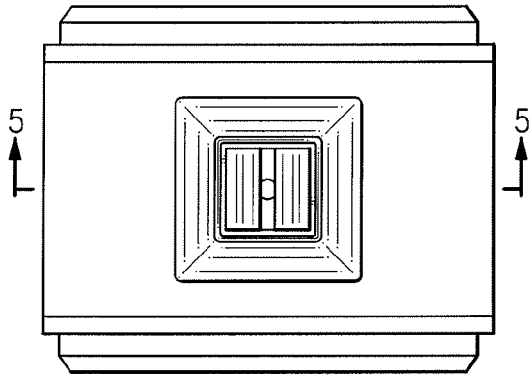
FIG. 4 is a bottom plan view of the baluster assembly of the present invention.
Figure 5:
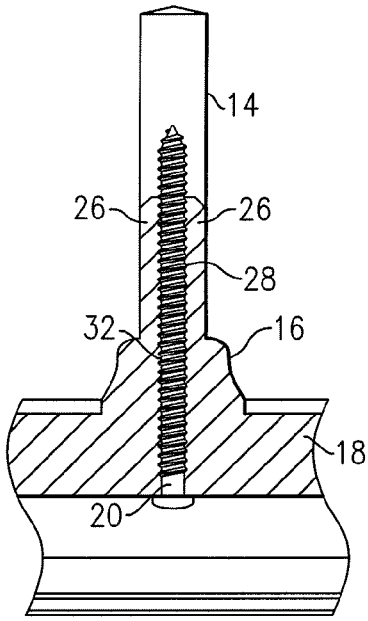
FIG. 5 is a sectional view of FIG. 4 at line 5-5.

As will be appreciated, the present invention provides a facile assembly for constructing and connecting a baluster and rail system. Reference is made to FIGS. 1 and 2, which illustrate alternate embodiments of the baluster and rail system 10. A baluster 14 is mounted on a baluster shoe 16 which is positioned on and mounted to a rail 18. FIG. 1 shows an angled baluster shoe base for mounting on an ascending rail or "stair section." The angle can vary and the ideal scenario is that all the balusters are the same length, from one angle section to another. This "stair" version is adjustable in angle while allowing for the same height. The angles are typically about 27 to about 37 degrees. FIG. 2 shows a straight or flat baluster shoe base for attachment to a horizontal rail. FIG. 3 is an exploded view of baluster 14, baluster shoe 16 and rail 18 with a screw 20, shown prior to installation, which screw connects all three components together. FIG. 4 is a bottom plan view after assembly of the components has occurred, showing screw 20 inserted into rail 18, baluster shoe 16 and baluster 14. In FIG. 5, a sectional view of FIG. 4 at line 5-5, the connection of all the components in relation to one another is illustrated.

Figure 6:
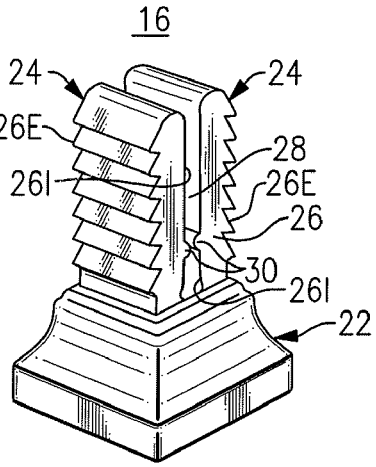
FIG. 6 is a perspective view of the baluster shoe of the baluster assembly of the present invention.
Figure 7:
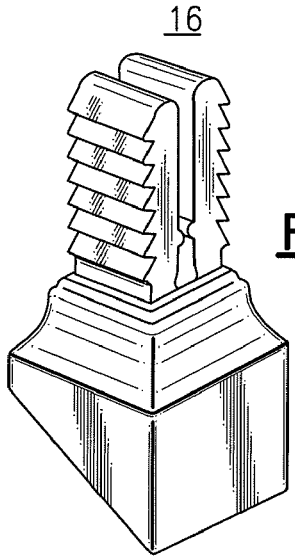
FIG. 7 is a perspective view of an alternate embodiment of the baluster shoe of the baluster assembly of the present invention.
Figure 12:
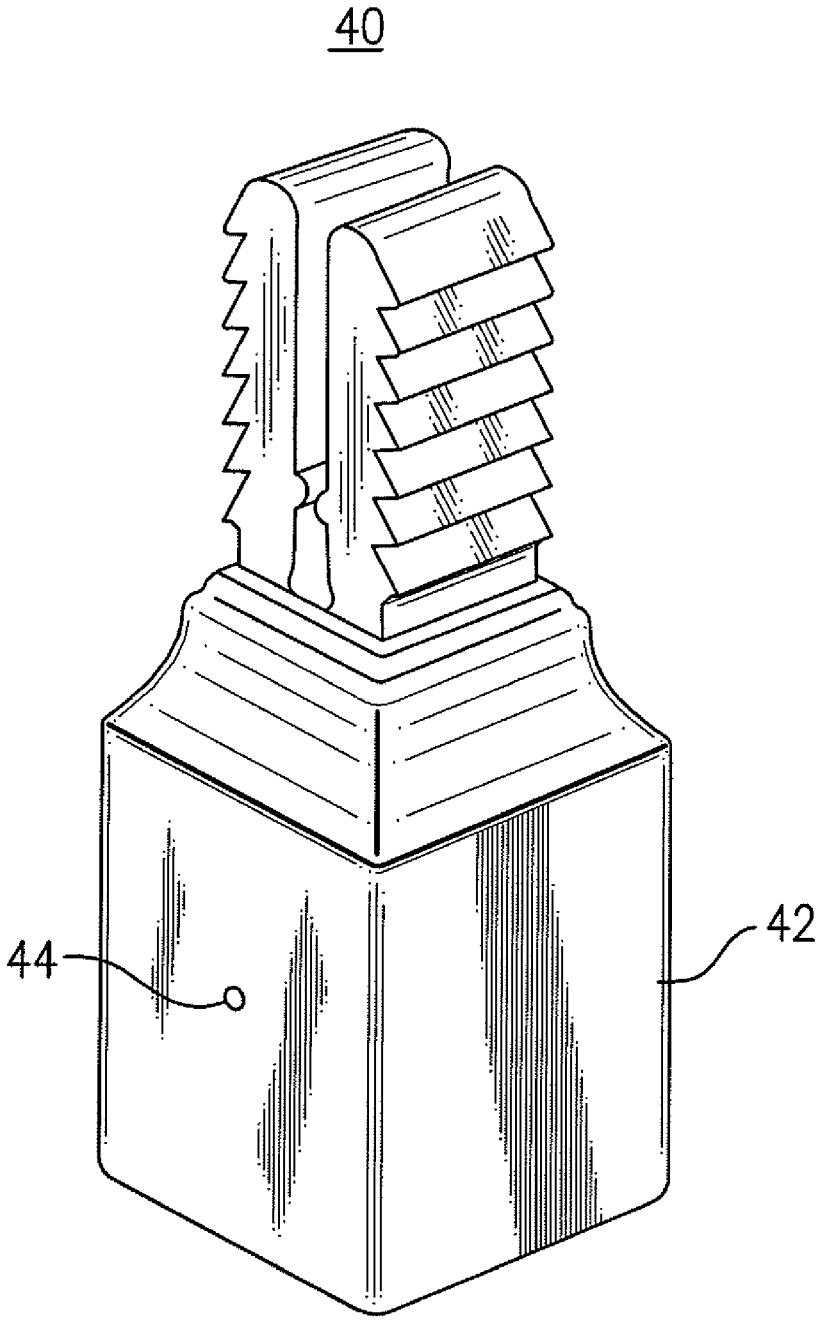
FIG. 12 is a perspective view of the baluster shoe of the present invention shown prior to cutting.

As clearly seen in FIG. 6, baluster shoe 16 has a base section 22 and an anchor section 24. The bottom or lower end of base section 22 may be straight as shown in FIG. 6, or angled, as shown in FIG. 7, depending upon the placement of the shoe. As discussed above, the placement of the shoe on a "flat section" of railing or a "stair section" will determine whether a flat shoe or an adjustable angled shoe will be used. Reference is made to FIG. 12, which shows a baluster shoe 40 prior to cutting base section 42. Base section 42 is tall to provide for a variety of angles that must accommodate the angle of the stair on which it will be positioned. A cut bump 44 is disposed on opposite faces of base section 42. Base 42 of shoe 40 is cut at the appropriate angle for the application using cut bump 44 by cutting through cut bump 44 to insure proper height and consistent height of all the balusters upon the rail. Turning again to FIG. 6, base section 22 may have a larger cross-sectional area, at least at one end thereof, than the cross-sectional area of anchor section 24, as viewed laterally, in order to prevent movement of baluster 14 and maintain baluster 14 in position. Base section 22 is shown as being of square cross-section, although other shapes may be used, such as conical, cylindrical and other polygonal shapes. Base section 22 may increase in cross-sectional area from proximal to distal end as shown in the Figure, or it may maintain constant dimensions from proximal to distal end thereof to provide the appearance of a continuation of the baluster.

Figure 8:
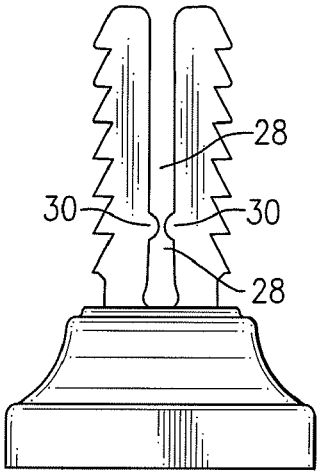
FIG. 8 is a front elevation view of the baluster shoe of FIG. 6.
Figure 9:
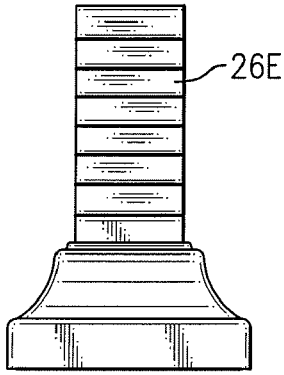
FIG. 9 is a side elevation view of the baluster shoe of FIG. 6.

Anchor section 24 of baluster shoe 16 is shown having two walls 26 extending vertically from base 22. Anchor section 24 may be fabricated of one wall, such as an axial wall, or a series of walls, two (as shown in FIG. 6) or more, which form an opening such as opening 28 shown in FIG. 8, to accept a screw therein. Anchor section 24 is fabricated of a rigid, but pliable or flexible material, such that opening 28 will expand upon insertion of a screw therein. Examples of materials useful for the manufacture of anchor section 22 herein include plastic materials, such as nylon, glass-filled nylon, polypropylene, polyvinyl chloride, or acrylonitrile butadiene styrene. Base section 22 may be fabricated of the same material as anchor section 24 or may be fabricated of a different material such as zinc or aluminum casting. Anchor and base sections 24 and 22, respectively, may be fabricated as a single piece by injection molding, machining or similar process, or may be fabricated as two pieces and bonded or mechanically fitted together.

Figure 10:
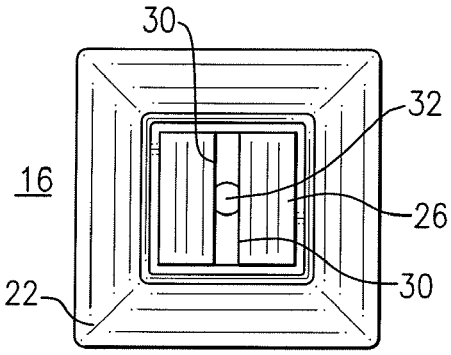
FIG. 10 is a top plan view of the baluster shoe of FIG. 6.

Base section 22 may be hollow or solid, having an opening 32, as shown in FIG. 10, which opening extends to anchor section 24, and leads into opening 28 in anchor section 24. The size of opening 28 is wide enough to fit a tip of a screw therein, such as a #8 pan head screw, but may be smaller than the diameter of the shaft of the screw so that the screw forces flexible walls 26 of anchor section 24 to spread out. In this way, the screw is snugly held in place and the anchor section is frictionally engaged within the channel of the baluster to maintain the baluster in position.

Figure 11:
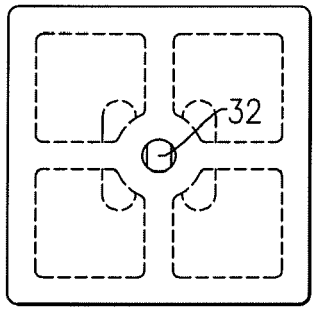
FIG. 11 is a bottom plan view of the baluster shoe of FIG. 6.

The interior sides **26*i* of walls 26 may include one or more protrusions or ribs 30 on each interior wall 26*i*, which may extend along the entire width of wall 26*i*. Protrusion 30 provides a secure fit for a screw inserted therein. FIG. 11 shows bottom plan view of baluster shoe 16 wherein the bottom of base section 22 has a configuration that provides a clearance hole 32 for insertion of a screw therein, which extends the height of base section 22, to guide the screw through the opening in base section 22 to opening 28 in anchor section 24**.

Additionally, it is preferable that the exterior sides **26*e* of walls 26 are provided with a serrated, notched or ribbed surface as shown in FIGS. 6-9, to provide frictional engagement of baluster shoe 16 within baluster 14. Reference is made to FIGS. 3 and 5, which clearly show assembly 10 in use. The interior of baluster 14 is a channel that is shaped similarly to baluster shoe 16 to provide easy insertion and a tight, secure fit of baluster shoe 16 therein. It is preferable that the interior of baluster 14 is shaped in the form of a square channel and that the overall cross-sectional shape of anchor section 24 is square in shape to provide a good fit between the two components, although rectangular, circular, oval, triangular, octagonal, hexagonal or other polygonal shapes may be used as long as the shape of the channel in baluster 14 matches the shape of anchor section 24. Moreover, the number of walls may vary depending on the shape used. For example, a square-shaped anchor section may contain four walls projecting vertically from base section 22, whereby the four walls form an opening centrally located to provide for insertion of a screw. Protrusions or ribs are disposed on the interior of the walls to provide a secure, tight fit for a screw inserted therein. Furthermore, the walls are flexible so that the walls spread outwardly upon insertion of a screw to engage the walls of the channel in baluster 14. Alternatively, anchor section 16 may be provided in round or oval cross-sectional shape in the form of an interior axial wall or two or more curved walls to from said shape, which shape would correspond to a round- or oval-shaped channel in baluster 14. Typically, anchor section 24 will be slightly smaller in area than the perimeter of the channel of baluster 14 such that baluster 14 fits securely over anchor section 24. It is preferable that anchor section 24 comprises two vertically extending parallel walls 24 as shown in FIG. 6**.

In operation, baluster 14 is placed over baluster shoe 16, which is positioned on rail 18. A screw 20 is inserted through opening 34 located in rail 18. The screw continues through clearance hole 32 (shown in FIG. 11) of baluster shoe 16 and up through opening 28 in walls 26. Walls 26 expand as screw 20 is inserted therein and frictionally engage baluster 14. Depending on rail 18, base 22 is either straight (flat) or angled to fit securely to rail 18.

Baluster shoe 16 is designed to spread open when a screw is inserted therein, acting similarly to a wall anchor. Baluster shoe 16 provides retention forces so that it cannot be easily pulled out of the baluster once the screw is inserted.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended embodiments.

What is claimed is:

1. A rail assembly comprising:

a rail member comprising a first major surface and a second major surface, with the rail member defining a screw hole extending from the first major surface of the rail member to the second major surface of the rail member;

an elongated baluster member defining an interior space;

a baluster shoe member comprising a base portion, a first flexible wall and a second flexible wall, with the base portion defining a screw hole; and a screw comprising a head portion and an elongated portion;

wherein:

the rail member, the baluster shoe member and the screw are assembled together so that the head of the screw is engaged with the first major surface of the rail member, the elongated portion of the screw extends through the screw hole of the rail member, and the elongated portion of the screw is in threaded engagement with the screw hole of the base portion of the baluster shoe and thereby secures the base portion of the baluster shoe against the second major surface of the rail member;

the baluster shoe member and the baluster member are assembled together so that the first flexible wall and the second flexible wall of the baluster shoe member extend into the interior space of the baluster member, but the base portion of the baluster member is shaped and sized so that it is prevented from extending into the interior space of the baluster member by physical interference between the baluster member and the base portion;

the first flexible wall is flexible between a first position not in frictional engagement with the baluster member and a second position in frictional engagement with the baluster member;

the second flexible wall is flexible between a first position not in frictional engagement with the baluster member and a second position in frictional engagement with the baluster member; and the elongated portion of the screw further extends beyond the base member so that it physically interferes with a protrusion of the first flexible wall and a protrusion of the second flexible wall to flex the first flexible wall and the second flexible wall from their respective first positions to their respective second positions.

2. The rail assembly according to claim 1 wherein:

the baluster member comprises a bottom edge;

the base portion of the baluster shoe member comprises a top side; and the bottom edge of the baluster sits flush against the top side of the baluster shoe member.

3. The rail assembly of claim 1 wherein the baluster shoe member and the baluster member are shaped and sized so that the base portion of the baluster shoe member appears as a continuation of the baluster member when the baluster shoe member and the baluster member are assembled into the rail assembly.

4. The rail assembly of claim 1 wherein:

the base portion of the baluster shoe member comprises a bottom side; and the bottom side of the baluster shoe member is perpendicular to a direction of elongation of the baluster member.

5. The rail assembly of claim 1 wherein:

the base portion of the baluster shoe member comprises a bottom side; and the bottom side of the baluster shoe member is oriented at an angle to a direction perpendicular to a direction of elongation of the baluster member.

6. The rail assembly of claim 5 wherein the angle is between 27 degrees and 37 degrees.

7. The rail assembly of claim 1 wherein:

the first major surface of the rail member is generally U-shaped; and the second major surface of the rail member is generally planar.

8. The rail assembly of claim 1 wherein the first flexible wall and second flexible walls are both made from one or more of the following materials:

nylon, glass-filled nylon, polypropylene, polyvinyl chloride and/or acrylonitrile.

9. The rail assembly of claim 1 wherein the baluster shoe member is fabricated as a single piece by injection molding.

* * * * *